US005121687A

United States Patent [19]

Arcotta

[11] Patent Number: 5,121,687

[45] Date of Patent: Jun. 16, 1992

[54] CASSETTE TAPE CARTRIDGE DIRECT INK PRINTING MACHINE

[76] Inventor: John Arcotta, 7647 W. Yucca Street, Peoria, Ariz. 85345

[21] Appl. No.: 548,674

[22] Filed: Jul. 5, 1990

[51] Int. Cl.[5] ..... B41F 17/20

[52] U.S. Cl. ..... 101/43; 101/42; 101/321

[58] Field of Search ..... 101/4, 11, 34–35, 101/40–44, 320, 321, DIG. 38

[56] References Cited

U.S. PATENT DOCUMENTS

| | | | |
|---|---|---|---|
| 2,172,318 | 1/1938 | Ferguson | 101/43 |
| 2,547,602 | 4/1951 | Schmitt | 101/44 |
| 2,624,279 | 1/1953 | Potnam et al. | 101/321 |
| 2,654,312 | 11/1954 | Phipps | 101/43 |
| 3,094,922 | 5/1962 | Crane | 101/44 |
| 3,225,689 | 11/1963 | Fuchs et al. | 101/44 |
| 3,225,690 | 12/1965 | Saeger | 101/320 |
| 3,228,326 | 1/1966 | Childress | 101/41 |
| 3,261,286 | 4/1964 | Hunter et al. | 101/321 |
| 3,886,860 | 6/1975 | Hayakawa | 101/41 |
| 3,892,174 | 7/1975 | Marcher | 101/41 |
| 3,911,812 | 10/1975 | Flynn et al. | 101/42 |
| 4,029,007 | 6/1977 | Levinson et al. | 101/42 |
| 4,182,239 | 1/1980 | Timmins et al. | 101/43 |
| 4,308,793 | 1/1982 | Shmidt | 101/41 |
| 4,377,111 | 3/1983 | Kincheloe et al. | 101/44 |
| 4,415,282 | 11/1983 | Euteneuer | 101/44 |
| 4,450,765 | 5/1984 | Van Steenkiste | 101/44 |
| 4,458,592 | 7/1984 | Jünghans | 101/DIG. 38 |
| 4,620,481 | 11/1986 | Steiner | 101/DIG. 38 |
| 5,014,150 | 5/1991 | Breuer et al. | 360/132 |

FOREIGN PATENT DOCUMENTS

| | | | |
|---|---|---|---|
| 0689891 | 4/1953 | United Kingdom | 101/44 |

*Primary Examiner*—Edgar S. Burr
*Assistant Examiner*—John S. Hilten
*Attorney, Agent, or Firm*—John P. McGonagle

[57] ABSTRACT

A printing system for directly printing on tape cassettes. A cassette feed assembly passes tape cassettes by means of a rail conveyancer to a printing assembly which has a back pressure plate subassembly on one side of the conveyancer for stiffening the cassette and a print head subassembly for direct printing on the cassette. A print inking system mounted over the print head subassembly inks the print head between cassette imprints. In an alternative embodiment, the back pressure plate assembly is replaced with a second print head subassembly and print inking system. An optional dryer station is provided after cassette printing.

21 Claims, 13 Drawing Sheets

CASSETTE TAPE CARTRIDGE DIRECT INK PRINTING MACHINE

BACKGROUND OF THE INVENTION

The present invention relates to printing machines, and more particularly to direct ink machines for printing on cassette tape cartridges.

Heretofore, printing on cassette tape cartridges was generally accomplished by preprinting labels and affixing the labels to the cassettes. Printing directly onto cassettes has been generally avoided because of the difficulties involved. Cassette cases are generally made of a thin plastic which tends to bend when a fixed pressure, such as from a print head, is applied. Furthermore, one side of a cassette is open for access to the enclosed tape by a tape player. The cassette opening case depth is increased to accommodate this opening thereby presenting a printing surface which is not flat. The effect of these two structural attributes of cassettes is that printing directly onto cassette generally results in a distorted, smudged and/or unfocused print image.

In more recent times, several machines have been developed to print directly onto cassettes. The machines developed have generally used offset printing processes and/or tapes. Offset printing onto cassettes requires many moving parts and results in complex and costly printing machines.

SUMMARY OF THE INVENTION

In view of the foregoing disadvantages inherent in the known types of machines now present in the prior art, the present invention provides an improved printing machine. As such, the general purpose of the present invention, which will be described subsequently in greater detail, is to provide a new and improved printing system for cassette cartridges which has a print quality comparable to offset printing processes, but has fewer parts, is easier to maintain and has a lower cost.

To attain this, the present invention combines a vertical cassette cartridge feed mechanism with a unique inking system and direct printing process. Ink rather than tapes are used. The complexity and expense of offset printing and tapes are thereby eliminated.

These together with other objects of the invention, along with various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE PREFERRED EMBODIMENT

Figure 1:
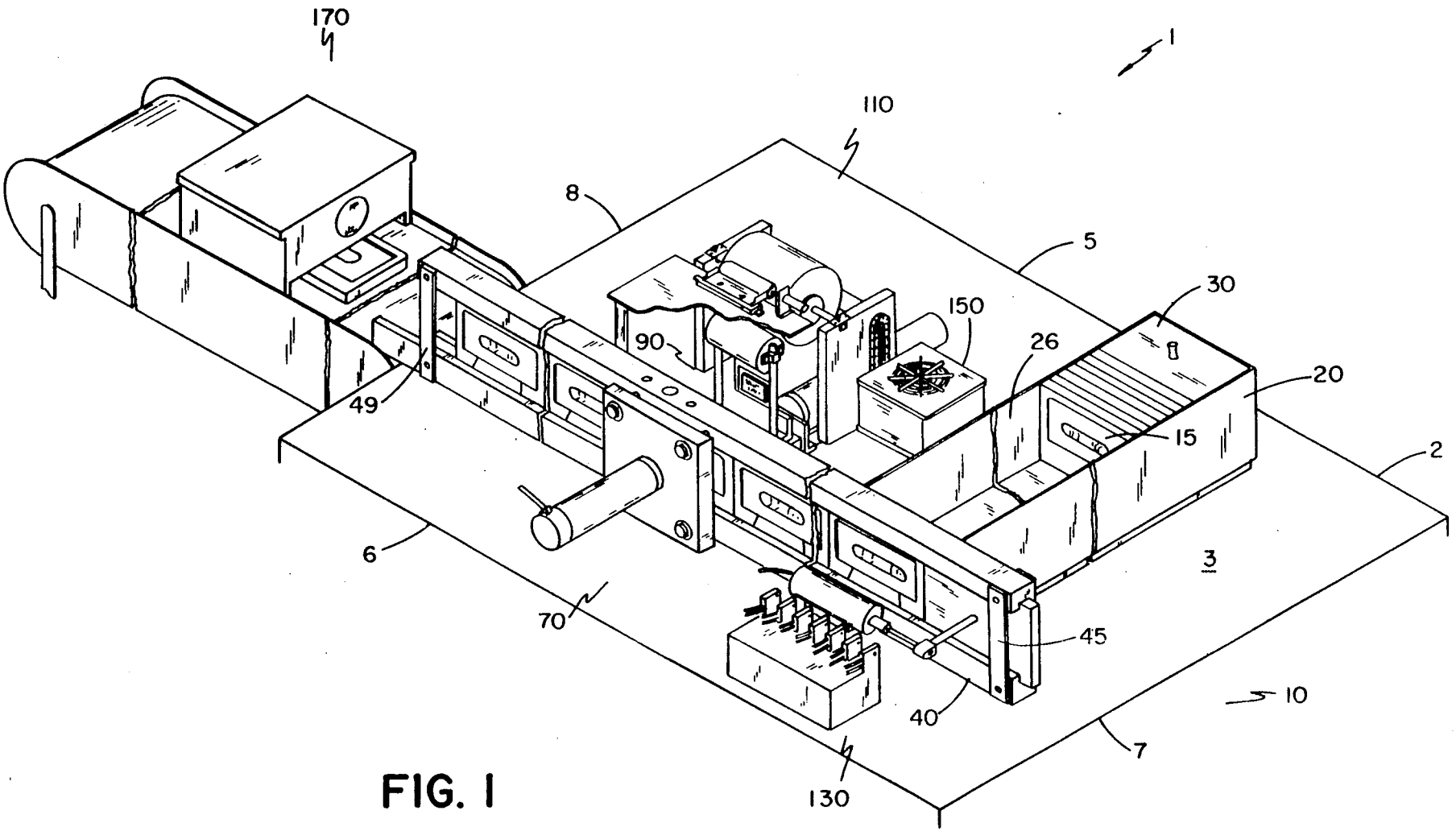
FIG. 1 is a perspective view of a cassette tape cartridge direct ink printing machine constructed according to the principles of the present invention.
Figure 2A:
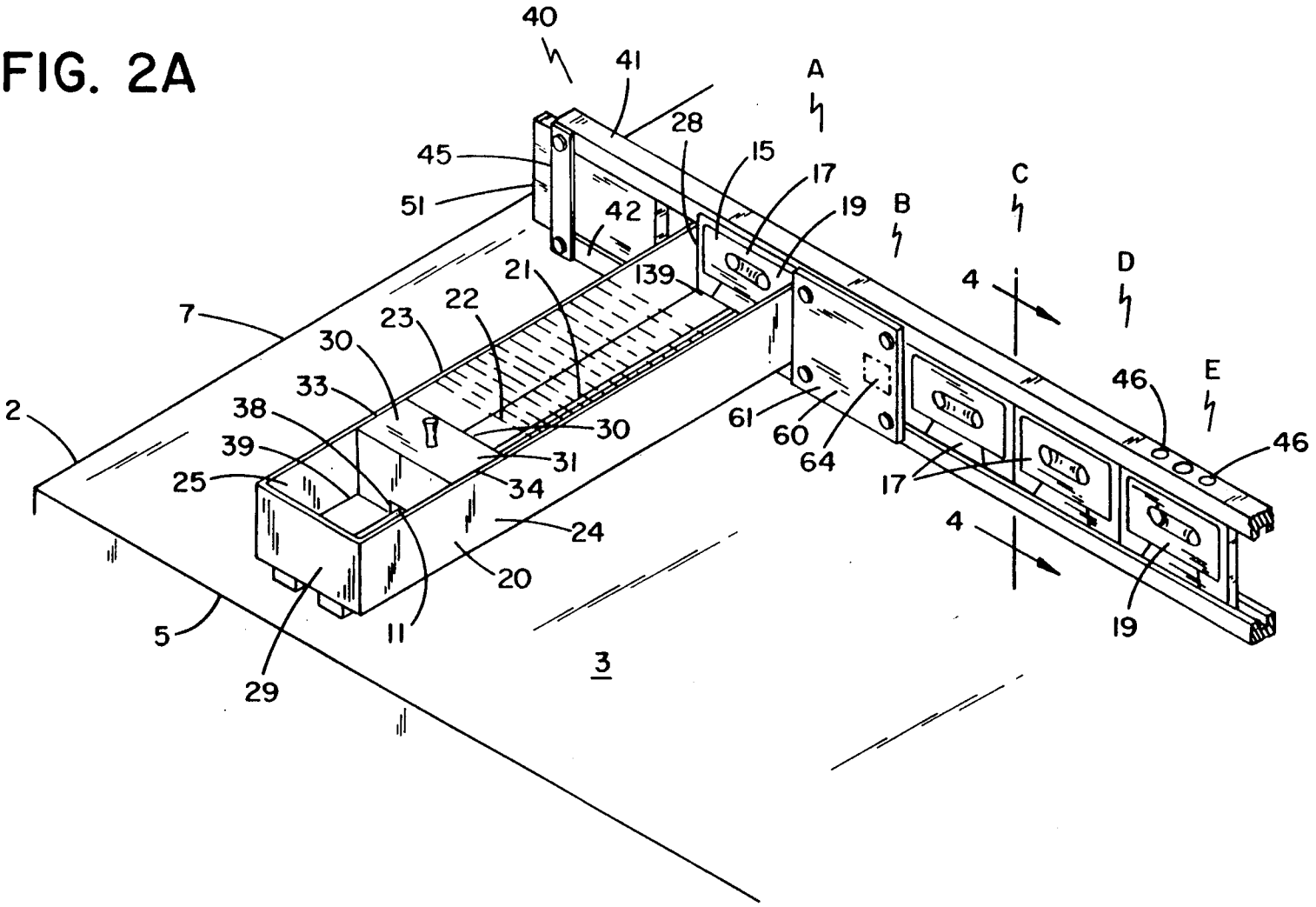
FIG. 2A is a front perspective view of the cassette feed assembly of the invention shown in FIG. 1.
Figure 2B:
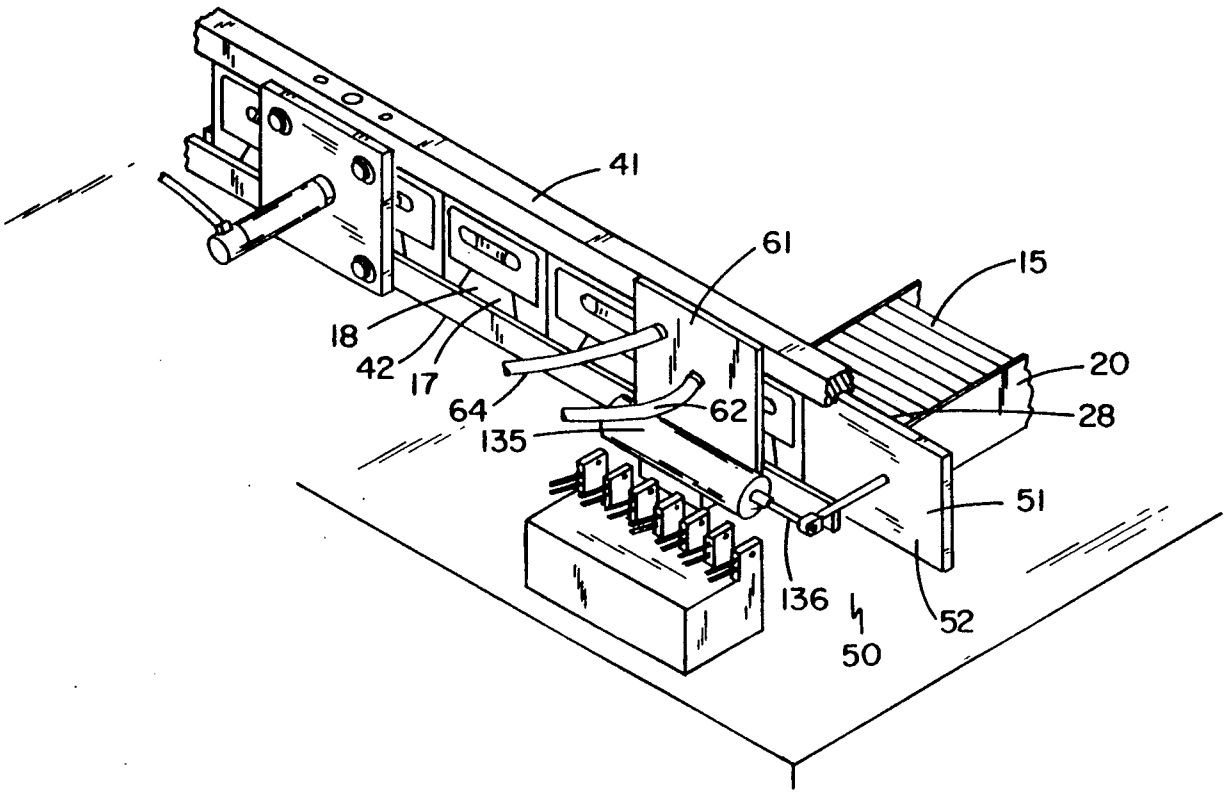
FIG. 2B is a rear perspective view of the cassette feed assembly of the invention shown in FIG. 1.
Figure 4:
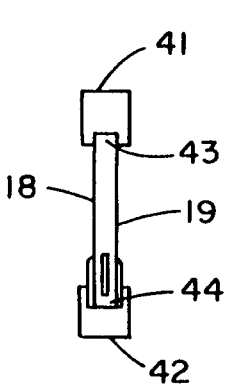
FIG. 4 is a sectional view along the line 4—4 of FIG. 2A.
Figure 3B:
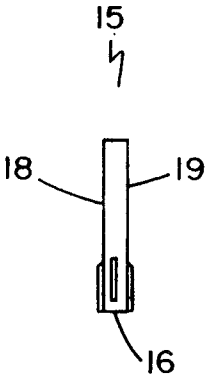
FIG.3B is a side elevational view of a cassette.
Figure 3A:
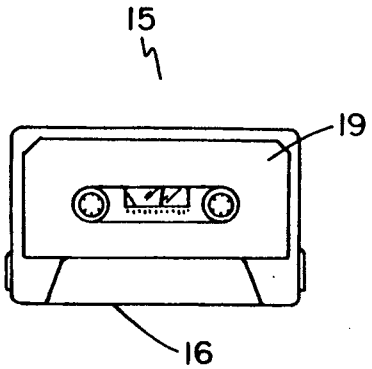
FIG. 3A is a front elevational view of a cassette.
Figure 5A:
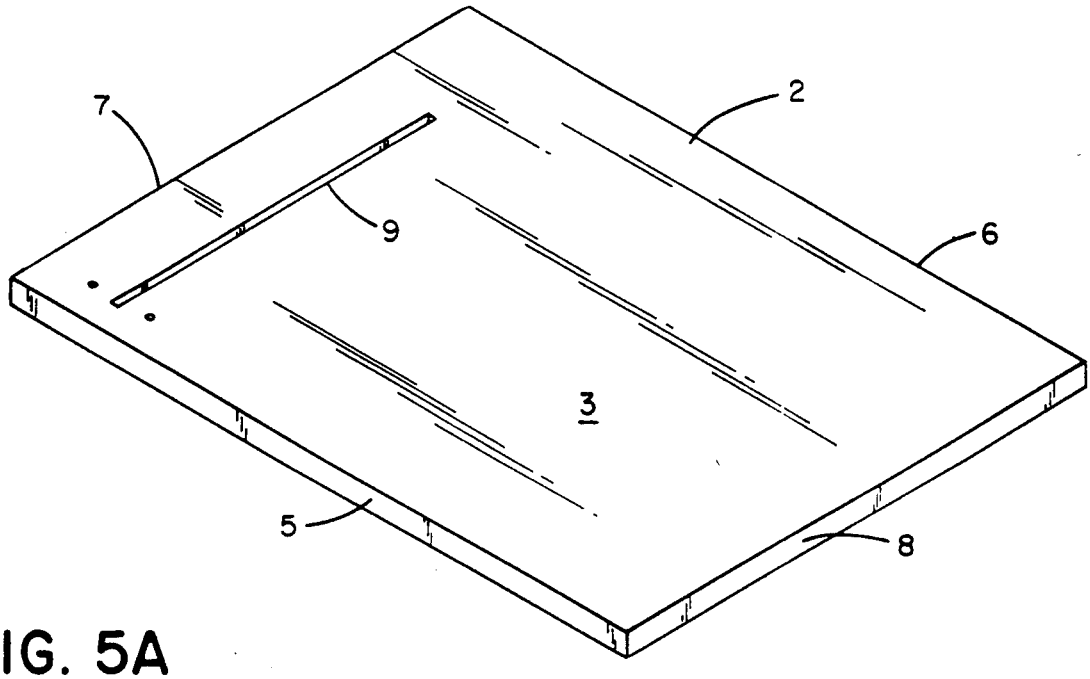
FIG. 5A is a top perspective view of the base of the invention shown in FIG. 1.
Figure 5B:
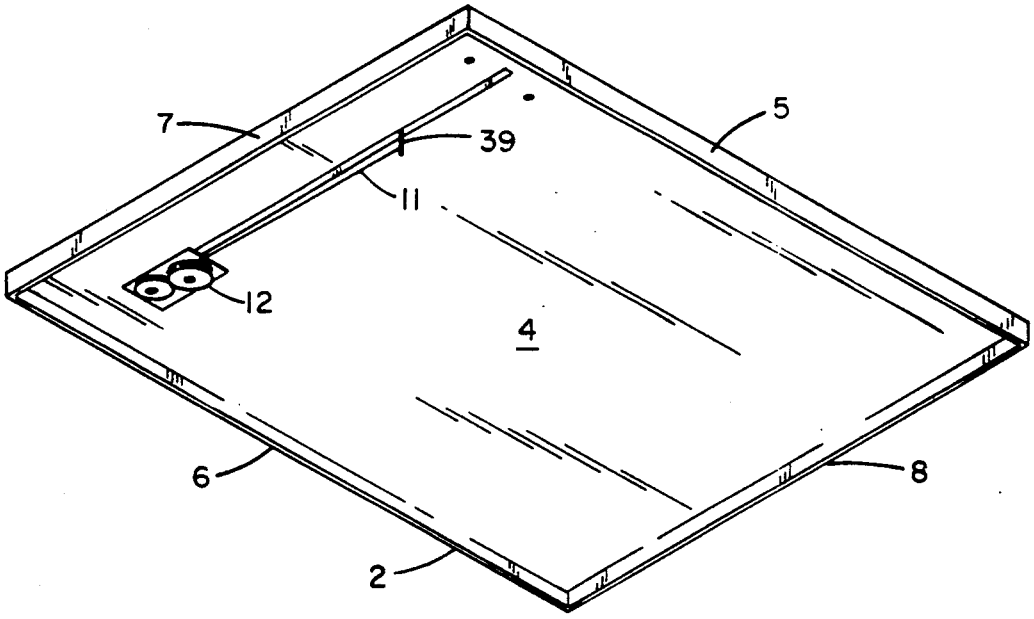
FIG. 5B is a bottom perspective view of the base of the invention shown in FIG. 1.
Figure 6:
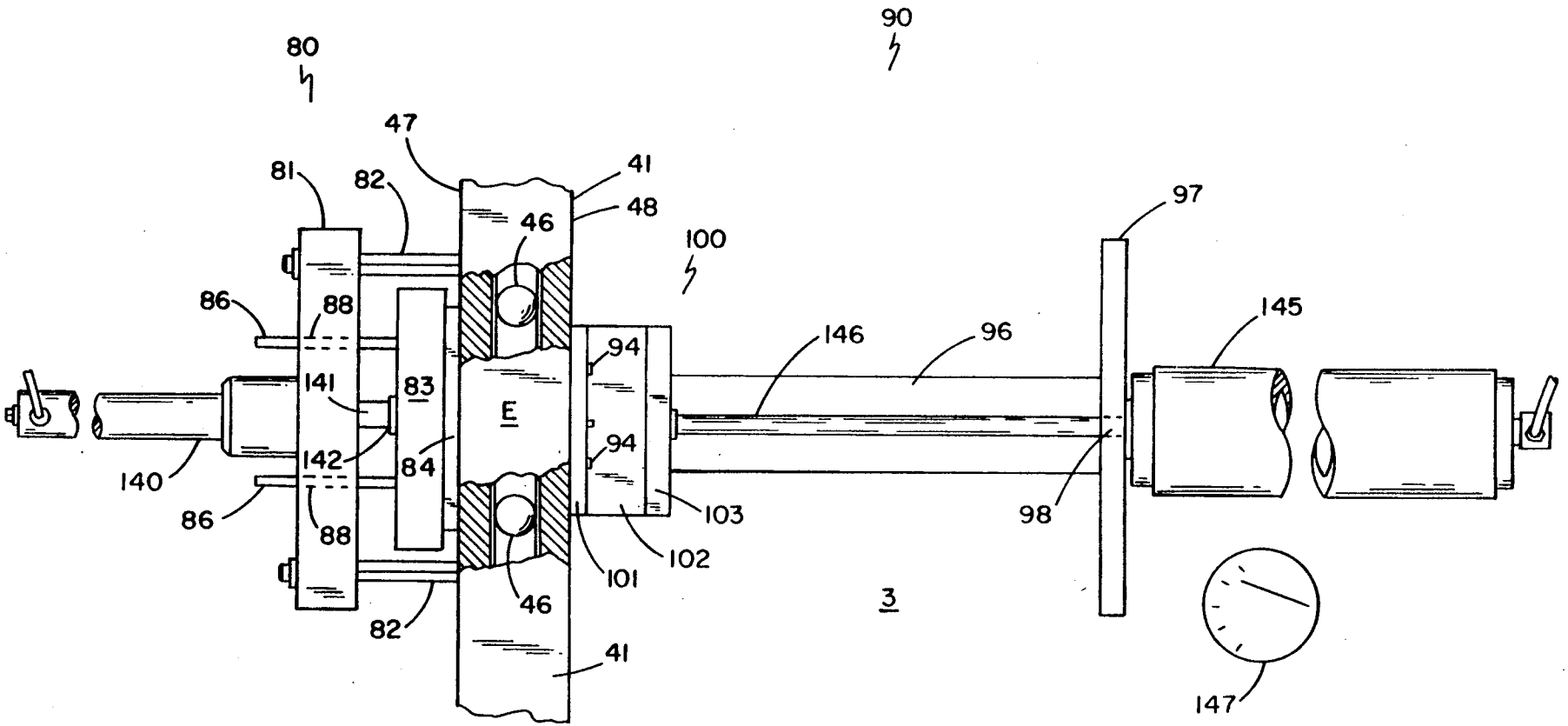
FIG. 6 is a top plan view of the printing assembly.
Figure 7:
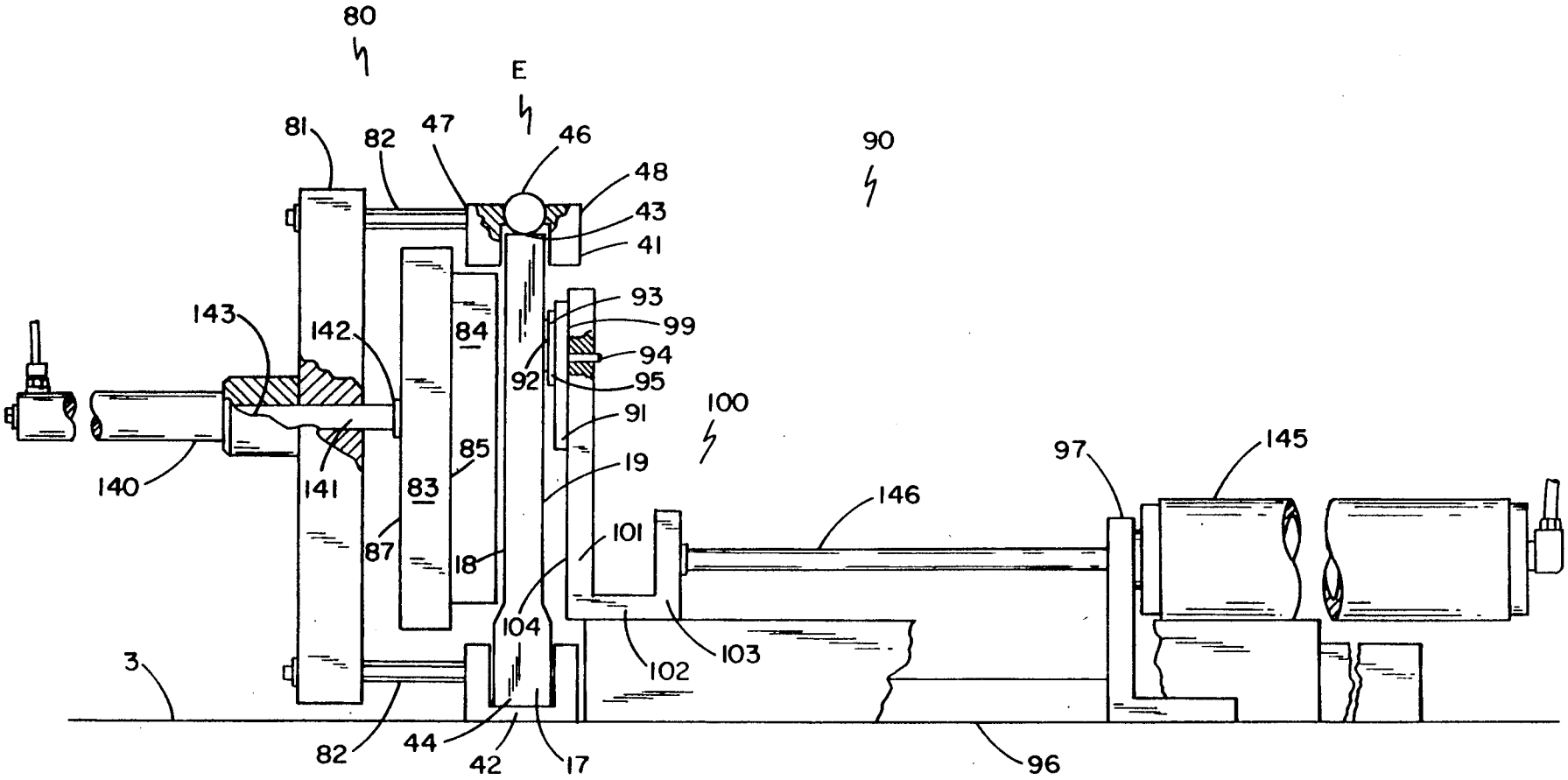
FIG. 7 is a side view of the printing assembly of FIG. 6 partly in section.
Figure 8:
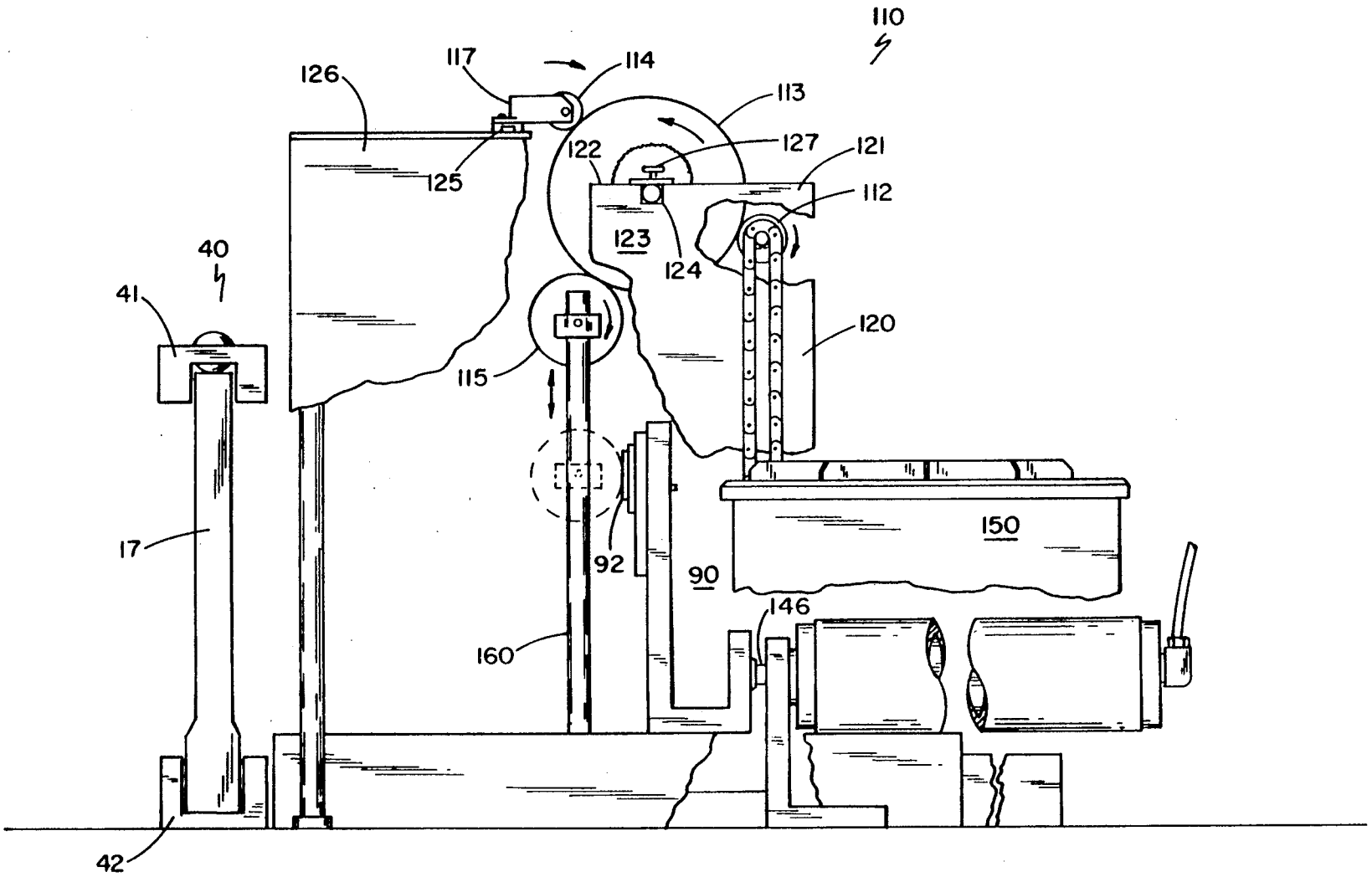
FIG. 8 is a side view of the invention print inking system.
Figure 9:
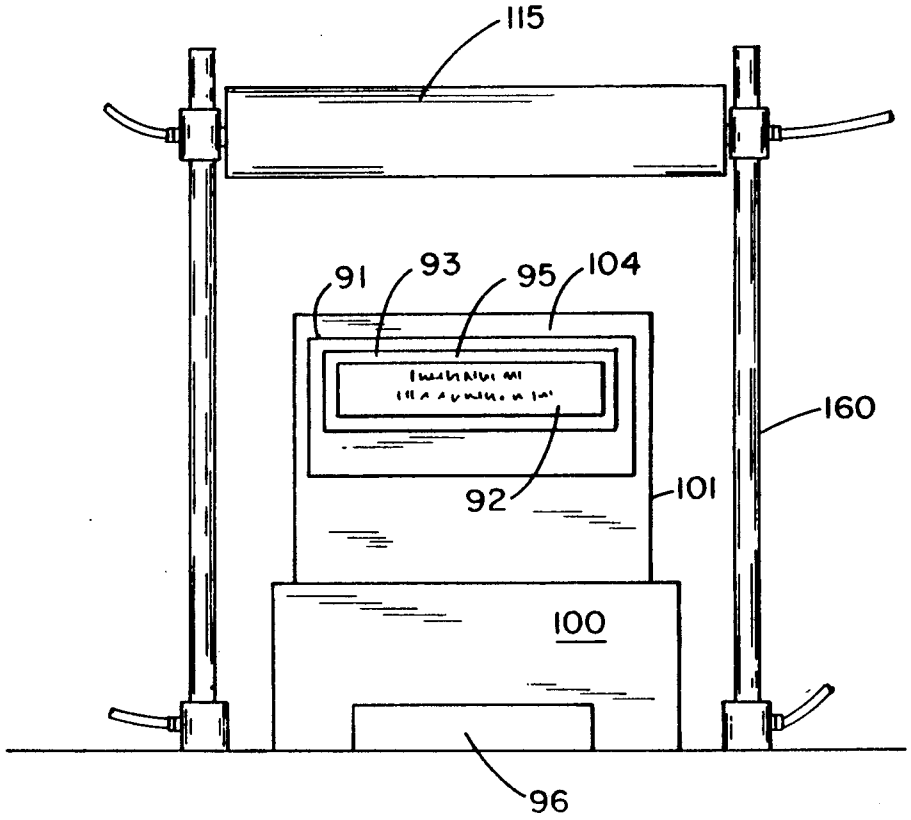
FIG. 9 is a rear view of the form roller and print head.
Figure 10:
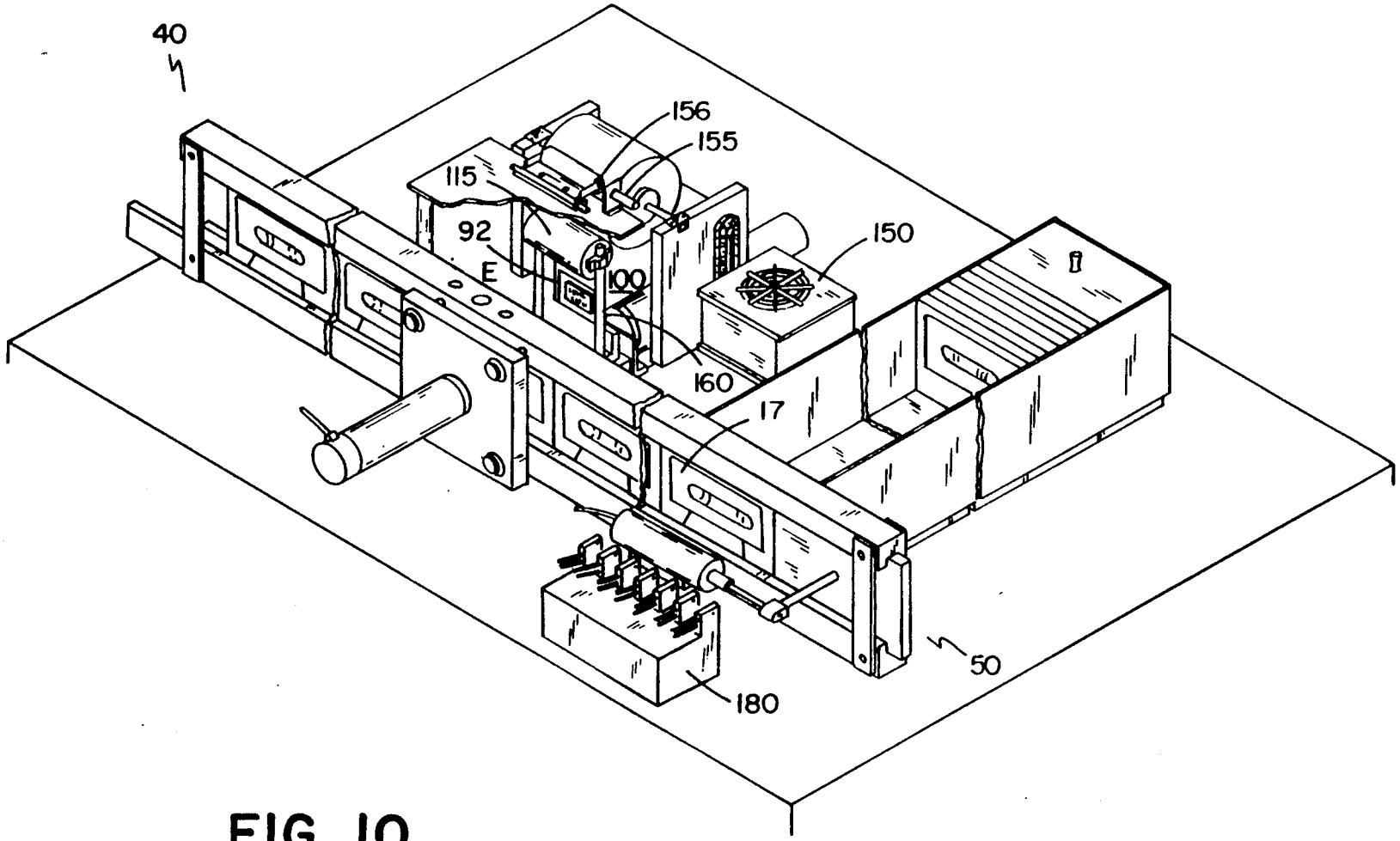
FIG. 10 is an enlarged rear perspective view of the invention illustrated in FIG. 1, showing the cassette feed assembly, inking system, and direct printing assembly.
Figure 11:
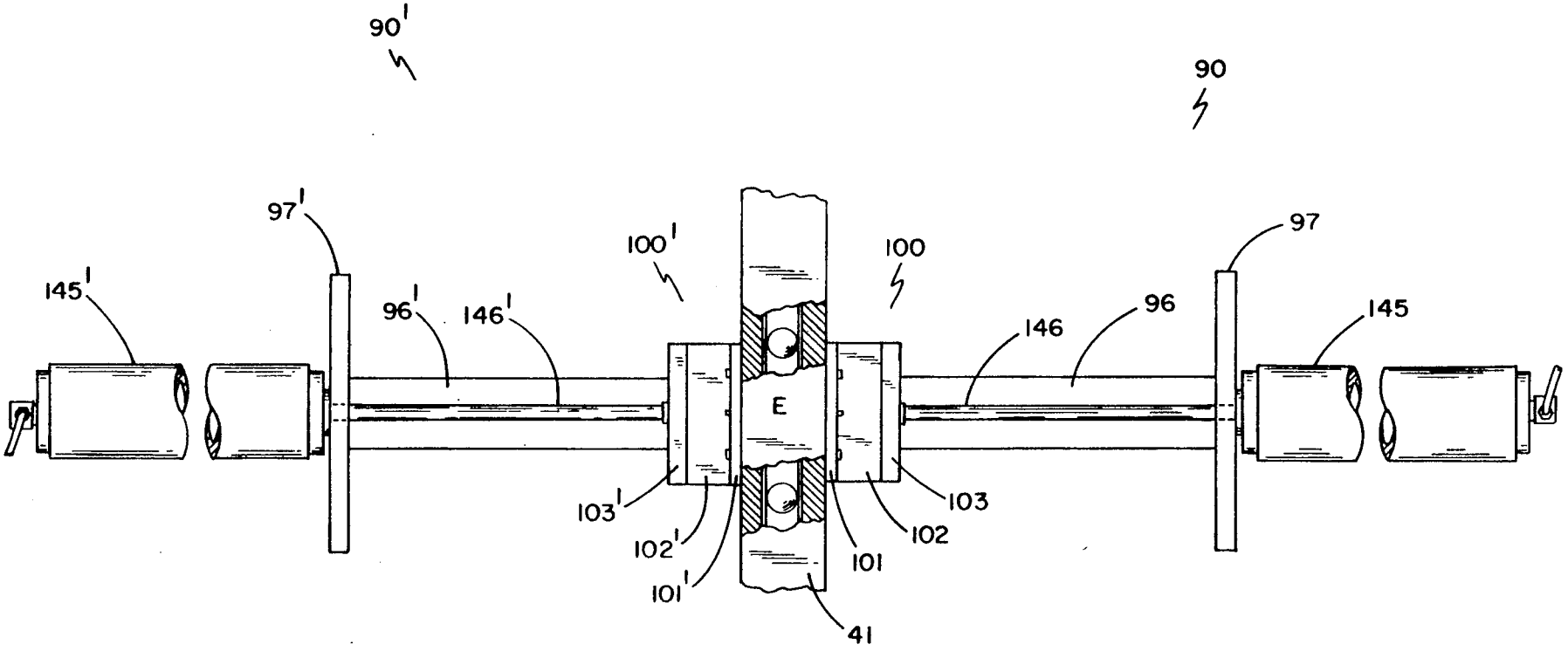
FIG. 11 is a top plan view of the printing assembly modified for two-sided printing.
Figure 12:
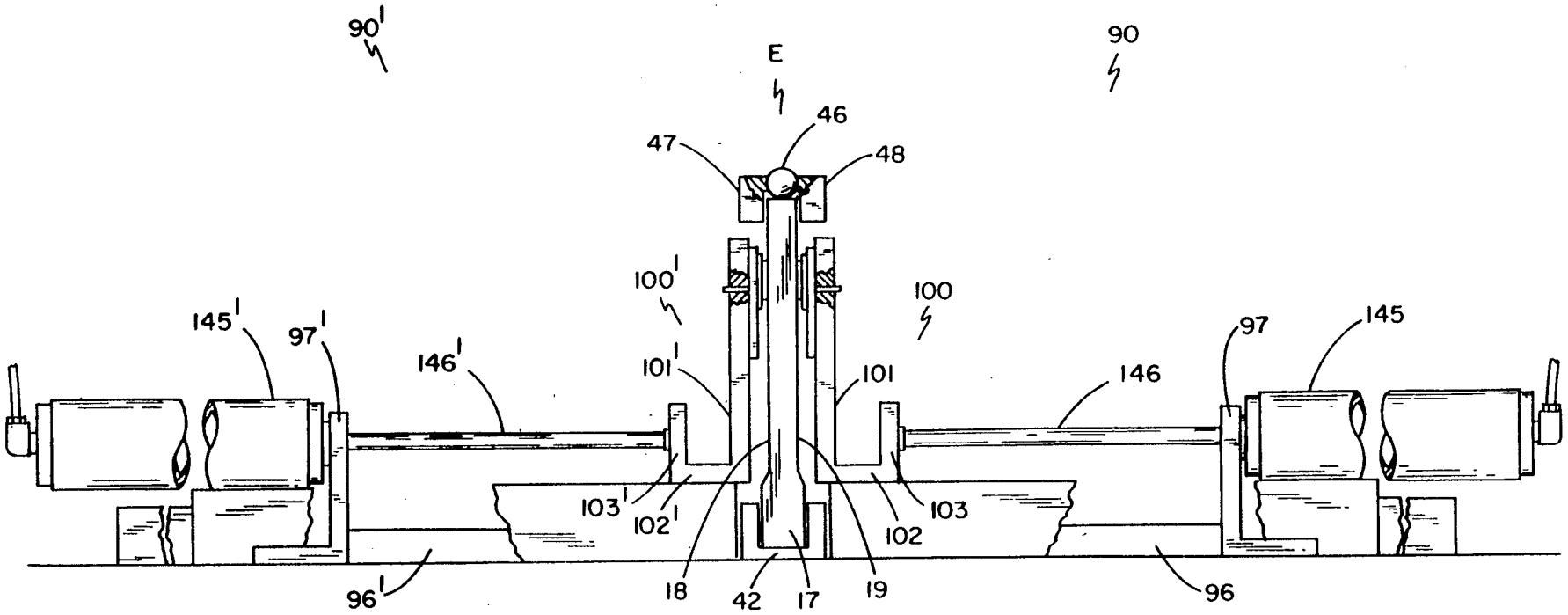
FIG. 12 is a side view of the printing assembly of FIG. 11 partly in section.
Figure 13:
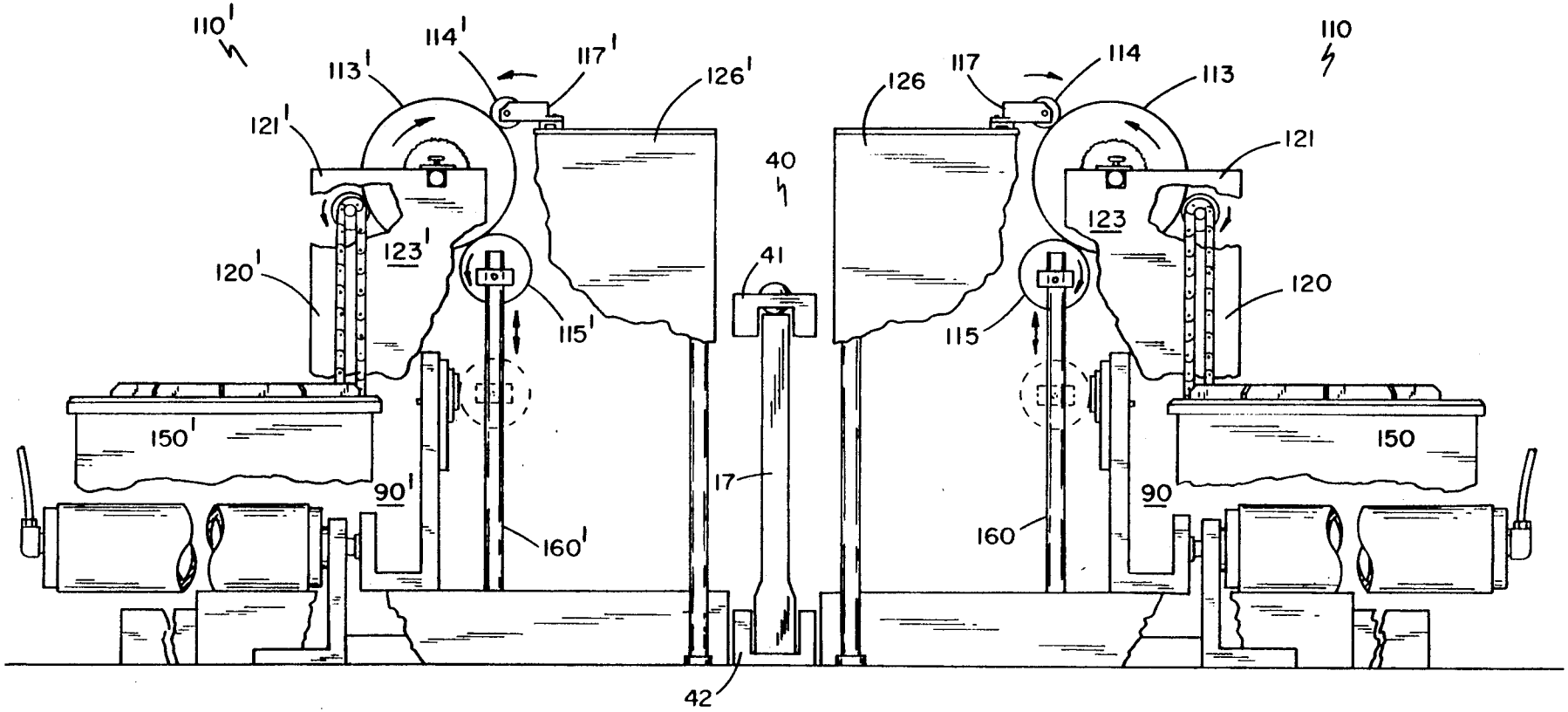
FIG. 13 is a side view of the invention print inking system modified for two-sided printing.

Referring to the drawings in detail wherein like elements are indicated by like numerals, there is shown an embodiment of the invention 1 incorporating a tape cassette cartridge feeding assembly 10, print inking system 110, and printing assembly 70. This embodiment of the invention 1 has five major components: cassette feed assembly 10, printing assembly 70, print inking system 110, drive and control system 130, and dryer station 170. The cassette feed assembly 10 stores cassette cartridges 15 in a supply chute 20, advances the cartridges 15, one at a time along a rail conveyancer 40, cleans the cartridge 15, and moves the cartridge 15 to a print position E. The cassette feed assembly 10 moves the cartridge 15 to the imprinting position E where it is held in registration while a print head subassembly 90 imprints the desired information on the cartridge 15. The print head subassembly 90 is inked by the print inking system 110. After the cartridge 15 is printed on, it is advanced along the rail conveyancer 40 and exits on to an optional ultraviolet or heat/air conveyorized dryer station 170. The drive and control system 130 coordinates and synchronizes all of the drive elements within the invention 1.

The invention 1 rests on a flat, horizontal, generally rectangular base plate 2 which has a top face 3, under face 4, front 5, back 6, left side 7, and right side 8. The positions of each major component will be described in terms of its relationship with the base plate 2. Rearward direction and force is toward the back side 6. Forward direction and force is toward the front side 5.

The cassette feed assembly 10 is comprised of a spring-powered, base-mounted reel cassette cartridge supply chute 20, rail conveyancer 40, and advance feeder mechanism 50. The supply chute 20 has an open-top, shoe box shape and is mounted on the top face 3 of the base plate 2, toward the base left side 7 with the chute's longitudinal axis parallel with the base plate left side 7. The chute 20 in this embodiment holds twenty five cassette cartridges 15. The cassette cartridges 15 each have a generally rectangular shape, enclosed on three sides and open on one side for access to the enclosed tape by a tape player. The open side 16 is along one of the long sides of the rectangle and will be defined as the bottom side 16 of the cassette cartridge 15. The cartridge side to be printed on will be termed the front face 19 and the opposite side will be termed the back face 18. The cartridges 15 are placed in the supply chute 20 vertically so that each cartridge 15 rests on its bottom side 16 and so that the front face 19 of each cartridge 15 faces toward the base plate front 5.

The supply chute 20 has a central, slit-like opening 21 in its bottom 22 along its longitudinal axis. The base plate 2 has a comparable slit-like opening 9 matching the supply chute's opening 21. A rectangular shaped square block 30 is positioned within the chute 20. The block 30 rests on the chute bottom 22 over the opening 21 and has a cable 11 fastened thereto. The cable 11 is attached to a vertical pin 38 mounted on the bottom side 39 of the block 30. The cable 11 travels through the chute bottom opening 21 and corresponding base plate opening 9 to a spring-powered, base mounted reel 12 mounted on the under face 4 of the base plate 2 near the base plate back side 6, rearward of the supply chute 20. The effect of this arrangement is that the block 30 exerts a constant rearward force against the cassette cartridges 15 stored in the supply chute 20.

The block's horizontal component 31 is perpendicular to and reaches from one chute side 23 to the other chute side 24 thereby holding the block 30 in a vertical position, perpendicular to the chute sides 23 and 24. The side ends 33 and 34 of the horizontal component 31 stay flush with the inner faces 25 and 26 of the chute sides 23 and 24, thereby keeping the front 36 of the block 30 perfectly flat against the front face 19 of the nearest cassette 15. This allows the block 30 to be held back toward the front 29 of the supply chute 20 against the action of the wire 11 and spring-loaded take up reel 12 while the chute 20 is being loaded with cassettes 15.

The supply chute 20 rear end 28 terminates at the rail conveyancer 40. The rail conveyancer 40 is positioned on the base plate top face 3 parallel to the base plate back side 6 approximately one-third of the distance from the base plate back side 6 to base plate front side 5. The rail conveyancer 40 is comprised of two parallel, slotted rails, one rail 41 vertically positioned over the other rail 42, both held in position by vertical end brackets 45 and 49 attached to the base plate top face 3. The rail slots 43 and 44 run the length of the rails 41 and 42 and face each other. The rail conveyancer 40 extends from the base plate left side 7 to the base plate right side 8. The rearward force of the block 30 on the chute cartridges 15 forces the rearward most cartridge 17 to enter the rail conveyancer 40. Reference numeral 17 will be used to refer to a cassette while it is contained within the rail conveyancer 40. The rail slots 43 and 44 are open to the supply chute 20 thereby allowing the cartridge 17 to slide into the rail slots 43 and 44.

The advance feeder mechanism 50 is comprised of a vertical plate 51 positioned between the rails 41 and 42 within the slots 43 and 44. In the "rest" mode, the vertical plate 51 is positioned to the left of and across the supply chute rear end 28 where the supply chute 20 terminates at the rail conveyancer 40. The advance feeder mechanism 50 is also comprised of a drive piston 136 driven by a pneumatic cylinder 135 on a base 137 which is positioned to the rear 47 and parallel to the rail conveyancer 40. The cylinder base 137 is attached to the base plate top face 3 rearward of the rail conveyancer 40. The piston arm 136 is attached to the rear face 52 of the vertical plate 51. In "activated" mode the pneumatic cylinder 135 operates so that on one stroke the piston arm 136 is contracted and the vertical plate 51 moves from right ("rest" or original position) to left (allowing cartridge 17 to enter rail conveyancer 40 from supply chute 20) to right within the rails 41 and 42 one cassette 15 cartridge length, thereby moving the cartridge 17 one position to the right within the rail slots 43 and 44. On each stroke of the advance feeder mechanism 50 the previously entered cartridges 17, 17', etc., are moved one position further to the right within the rail slots 43 and 44 and another cartridge 17'' is moved into the rail conveyancer 40.

The rail conveyancer 40 has an optional vacuum chamber cleaning system 60 mounted to the right of the supply chute 20. The purpose of the cleaning system 60 is to rid each cartridge 17 of dust and lint particles. The cleaning system 60 is comprised of a housing 61 positioned over a section of the conveyancer 40 with a vacuum suction line 62 attached thereto from an external vacuum source. The vacuum removes loose dust and other particles from the cassette cartridge 17. A felt pad 64 impregnated with alcohol (0.99% concentration) is positioned within the housing so that the cartridge 17 must pass against it. This cleans all contaminants such as skin oil, injection molding release agents and other foreign matter. The alcohol impregnates the pad via a line 64 from an external alcohol container. Any alcohol left on the cassette 17 evaporates before the cassette 17 reaches the printing stage.

There are five cassette positions within the rail conveyancer 40. Position A is for the cassette 17 being loaded. Position B is for cassette 17 cleaning. Positions C and D are for cassette 17 drying and/or setup. Position E is for cassette 17 printing. Further positions may be added after the print position E for distribution, UV drying, etc. A micro switch 139 is located at the rear end 28 of the chute 20. This switch 139 senses when the last cassette 17 has reached the end 28 of the chute 20. This means that the last cartridge 15 (17) has been loaded into the rail conveyancer 40. After the last cassette cartridge 17 is loaded into the rail conveyancer 40 by the advance feeder mechanism vertical plate 51, the vertical plate 51 comes to the "rest" position, moving the imprinted cassette cartridge 17 out of the print position E, and moving the cassette cartridge 17 preceding the imprinted cassette cartridge 17 to the print position E. The machine 1 then shuts off.

The cartridge 17 advances through each advance feeder mechanism 50 stroke cycle to the print position E where the cartridge 17 comes to rest and is held in registration by two spring loaded ball plungers 46 located in and through the top rail 41 into the top rail slot 43. The ball plungers 46 are adjustable for variations in cassette cartridges 17 and various manufacturers of cassette cartridges. Registration is accomplished by resistance in the amount of spring pressure applied to the ball plungers 46 thereby holding the cartridge 17 firmly in place within the rail slots 43 and 44 for imprinting.

The printing assembly 70 is comprised of two main components, a back pressure plate subassembly 80 and a print head subassembly 90. The back pressure plate subassembly 80 is positioned perpendicular to and on the back side 47 of the rail conveyancer print position E. The print head subassembly 90 is positioned perpendicular to and on the front side 48 of the rail conveyancer print position E. As a cartridge 17 is placed in registration in the print position E, the back pressure plate subassembly 80 is activated and presses against the back side 18 of the cartridge 17, providing stiffness to the cassette cartridge 17 and countering the rearward pressure from the print head subassembly 90 during the printing process. This overcomes the problems of the prior art whereby print images would be distored due to the bending action of the cartridge casing when pressure from a print head is applied during the printing process.

The back pressure plate subassembly 80 is comprised of a vertical brace plate 81 fixedly attached to the back side 47 of the upper 41 and lower 42 railings by means of four railing standoffs 82. A vertical pressure plate 83 facing the print head subassembly 90 and having a rubber pad 84 attached on its front face 85 is attached to the plate 81 by means of two guide rods 86 and a piston arm 141 connected at one end 142 through the brace 81 to the vertical pressure plate rear face 87 and driven at its other end 143 by the pneumatic cylinder 140. The guide rods 86 are attached to the pressure plate rear face 87 and pass through openings 88 in the brace 81. The guide rods 86 keep the vertical pressure plate 83 in a flat vertical plane parallel to the rear face 18 of the cassette cartridge 17 to be printed on. The piston arm 141 drives the plate 83 to and from the cassette 17 to be printed on. The guide rods 86 slide through the brace openings 88 as the pressure plate 83 is moved to and from the cassette 17 by the piston 141. The rubber pad 84 provides resiliency and elasticity to accommodate surface irregularities on the cassette 17. The pneumatic cylinder 140 is synchronized with the advance feeder mechanism 50, closing on the cassette 17 when the advance feeder mechanism 50 completes its stroke.

While the back pressure plate 80 presses forward against the rear face 18 of the cartridge 17, upright within the rails 41 and 42, the print head subassembly 90 moves rearward to print on the cartridge front face 19. The print head subassembly 90 has a printing carriage 100 with a rearward flat vertical member 101, a forward flat vertical member 103, and an interconnecting horizontal member 102. The rearward carriage member 101 has a detachable, multi-die print holder 91 with a printing die 92 attached thereto on its rear face 104. In other embodiments a rubber chase 93 could be used. The chase 93 would be held in place with double stick tape to the holder 91. The die 92 would then be attached to the chase 93. The printing carriage 100 is not removed from the print head subassembly 90 once aligned and installed in the manufacture and assembly of the machine 1.

The multi-die print holder 91 is held in place to the carriage rearward vertical member rear face 104 by two thumb screws 94 which are also used to align the holder 91. The holder 91 comes off to install the die 92 and to register it from left to right. The multi-die print holder 91 is vertically slotted on its rear side 99 so that top to bottom alignment can also be determined or changed. When the alignment of the die 92 is completed, the holder 91 is attached to the carriage rearward vertical member rear face 104 to begin the printing process. In this embodiment of the invention 1 a ¼ inch thick pad 95 made from dense foam rubber is inserted between the print holder 91 and the die 92 where a chase 93 could optionally be. The pad 95 is fixedly attached to the print holder 91 and the die 92 removably attached thereto. Use of the pad 95 permits printing with as low as 30 pounds of air pressure as compared to 60 pounds of air pressure without the pad. The pad 95, due to its elasticity and resiliency, dynamically adjusts for cassette surface irregularities.

The printing carriage 100 travels rearward to the cartridge front 19 via a precision ball slide 96 mounted and aligned on the base plate top face 3. The printing carriage 100 interfaces with a pneumatic cylinder 145 mounted to a bracket 97 that bridges the ball slider mechanism 96 and holds the pneumatic cylinder 145 in place. The cylinder's piston 146 has a six inch stroke and a 1½ inch bore, slides through the brace opening 98, and is connected to the forward flat vertical member 103. The cylinder 145 is regulated to the proper printing pressure. It can be regulated manually and can be seen on a pressure gauge 147. For best printing results, print head pressure is regulated between 25 and 45 psi. This pressure can be controlled in either the automatic or manual modes of machine 1 operation. The cylinder piston 146 is synchronized with the back plate subassembly piston 141 both extending the back plate subassembly pressure plate 83 and printing carriage 100 toward the cassette 17 in Position E at the same time. This results in the print die 92 and rubber pad 84 meeting at the cassette 17 to be printed at the same time. The pressure plate 83 and printing carriage 100 are then brought back to their starting positions as the advance feeder mechanism 50 moves another cassette 17 into the print position E and the printed cassette out of position E.

The die 92 is inked by the print inking system 110. The print inking system 110 is comprised primarily of a driver roller 112, a ductor roller 113, an oscillating roller 114, and a form roller 115. The drive roller 112 is mounted between two parallel vertical brackets 120 which in turn are mounted in front of two parallel vertical brackets 126 positioned to either side of the print head subassembly 90 and forward of the rail conveyancer 40. The drive roller 112 is mounted between the upper forward quadrants 121 of the brackets 120, and its longitudinal axis lies in a plane parallel to the rail conveyancer 40 longitudinal axis. The drive roller 112 is made of steel and is belt driven by a motor 150 rotating at 124 RPM attached to the base plate top face 3. A direct drive gear motor could also be used.

The ductor roller 113 is mounted between the two brackets 120 on the upper edge 122 of the upper quadrants 123 of the plate brackets 120. The ductor roller 113 is aligned parallel to the drive roller 112 and is positioned between it and the rail conveyancer 40. The ductor roller 113 is positioned in a slot 124 located on top and rearward on the bracket 120 and is pressure adjusted by two thumb screws 127 located one each across the top side of the slots 124. The ductor roller 113 central longitudinal axis is in a horizontal plane above that of the driver roller 112 central longitudinal axis.

An oscillating roller 114 is positioned parallel to, against, and rearward of the ductor roller 113 and above the form roller 115. The oscillating roller 114 moves side-to-side across the face of the ductor roller 113 which therewith distributes ink evenly on the ductor roller 113, form roller 115, and drive roller 112. The oscillating roller 114 is mounted on an adjustable (front-to-back) bracket 117 mounted on the top side of the parallel brackets 126 housing the rod cylinders 160. The oscillating roller mechanism 114 is mounted on a precision ball slider 125 which moves side-to-side in a horizontal plane. The oscillating roller slider 125 moves in a side-to-side horizontal motion along an axis parallel to the longitudinal axis of the rail conveyancer 40 and is controlled by a pneumatic cylinder 155 having a piston 156 with a ½ inch bore and 2 inch stroke, and speed controls. Rotation of the oscillating roller 114 is obtained from pressure against the ductor roller 113 which obtains its rotation from the driver roller 112 which in turn is driven by the motor 150.

The form roller 115 inks the die 92 in the print head subassembly 90. The form roller 115 is mounted between two vertical rod cylinders 160, each of which is positioned between a plate bracket 120 and the rail conveyancer 40. The form roller 115 is positioned below the plane of the oscillating roller 114, rearward of, parallel to, and against the ductor roller 113. The form roller 115 inks the die 92 by moving in a vertical motion over the rubber die plate 92 in a free rolling motion. In the "up" position, the form roller 115 engages the ductor roller 113 and is re-inked on contact. As the form roller 115 moves to the "down" position, it travels across and against the die 92 thereby re-inking the die 92. The form roller 115 moves vertically on the two vertical rod cylinders 160 each of which has speed controls. The form roller 115 moves vertically down and up across the die 92 during the advance feeder mechanism 50 stroke while the print head subassembly piston 146 is in the fully retracted position.

To ink the form roller 115, a paste ink is applied to the ductor roller 113. The ink paste is a specially formulated ink for printing on plastic. Although the driver roller 112 initially distributes the ink paste 120 over the ductor roller 113, the amount of ink actually reaching the form roller 115 is controlled by the oscillating roller 114 pressure against the ductor roller 113. Increasing the pressure of the oscillating roller 114 against the ductor roller 113 will decrease the amount of ink transferred to the form roller 115 and therefore the die 92. Decreasing the pressure of the oscillating roller 114 against the ductor roller 113 will increase the amount of ink transferred to the form roller 115 and therefore the printing die 92. One ink application generally lasts for 300 cassettes, with 5 lines of print each.

After a cartridge 15 is printed on it exits the rail conveyancer 40 to an optional dryer station 170 set up by the operator. A conventional heat drying, air drying, or UV drying system is used. An added advantage of the present invention print inking system 110 is that the ink is uniformly thinned out enough for efficient UV drying, thereby speeding up the printing process. UV drying takes 3 to 4 seconds per cassette while heat drying takes 23 to 25 seconds per cassette. Air drying takes still longer.

The invention drive and control system 130 is comprised primarily of the previously described pneumatic cylinders which in turn are controlled by a cam system 180. The present embodiment has four actions per cycle. The first action is the loading of a cassette 17 into the rail conveyancer 40. The second action is the form roller 115 inking the die 92. The third action is the combined movement of the back pressure plate 83 and printing carriage 100 to and against the cartridge 17 in position E. The fourth action is the advance feeder mechanism 50 moving all of the cassettes 17 within the rail conveyancer 40 one position to the right. Upon completion of the fourth action with the return of the advance feeder mechanism 50 to its original start position, another cassette 17 is automatically loaded into the rail conveyancer 40 thereby completing the first action of the next cycle.

The cams 180 controlling the individual actions may be operated separately (semi-automatic) or in unison (automatic). The cam assembly 180 has its own gear motor, control pneumatic switches, valves and cylinders which all have speed control valves. The functions of the cam system 180 are to first operate a digital counter; secondly, control the advance feeder mechanism 50; thirdly and fourthly, control the rod cylinders 160 of the form roller 115; fifthly, activate and control the printing carriage 100; sixthly, activate and control the vertical pressure plate 83; and seventhly, activate the oscillating roller to evenly distribute ink on the ductor roller 113 and thereby the form roller 115.

The present invention is easily modified for two-sided printing. A mirror 90' of the print head subassembly 90, without a back pressure plate subassembly 80, and a mirror 110' of the print inking system 110 would replace the original back pressure plate subassembly 80. The print head subassemblies 90 and 90' for each print assembly 70 and 70' would provide the functions of the original back pressure plate subassemblies 80 and 80'.

It is understood that the above-described embodiment is merely illustrative of the application. Other embodiments may be readily devised by those skilled in the art which will embody the principles of the invention and fall within the spirit and scope thereof.

I claim:

1. A cassette tape cartridge direct ink printing machine comprising:

a base plate;

a cassette tape cartridge feeding assembly mounted on said base plate comprised of a cassette supply chute, a rail conveyancer assembly perpendicularly joined to said supply chute, and a feeder mechanism for moving cassettes from said supply chute into and along said rail conveyancer;

a printing assembly mounted on said base plate comprised of a print head subassembly and back pressure plate subassembly juxtaposed on opposite sides of said rail conveyancer in position to operate on cassettes within said rail conveyancer; and a print inking system mounted on said base plate above said print head subassembly comprised of two parallel plate brackets each one positioned on one side of said print head subassembly, a cylindrical drive roller attached to said brackets and having a central longitudinal axis positioned in parallel with said rail conveyancer, means to radially drive said roller, a ductor roller attached to said brackets and positioned against and in parallel to said driver roller between said roller and said rail conveyancer, a form roller positioned below and in parallel to said ductor roller and mounted between two vertical rod cylinders positioned between said plate brackets and said rail conveyancer whereby said form roller moves in a vertical motion on said rod cylinders and engages said ductor roller at the apogee of its upward motion and rolls across the face of said print head subassembly during its downward motion, an oscillating roller mounted on a bracket mounted on the top side of parallel brackets housing said rod cylinders wherein said oscillating roller is positioned parallel to and against said ductor roller, and means for moving said oscillating roller side-to-side across the face of said ductor roller.

2. A printing machine as recited in claim 1 wherein:

said back pressure plate subassembly is positioned perpendicular to said rail conveyancer on the side opposite to said print head subassembly and is comprised of a vertical brace plate fixedly attached to the rail conveyancer, a vertical pressure plate facing said print head subassembly and slidably attached to said brace plate by means of a plurality of guide rods and a piston arm connected at one end through said brace plate to drive means positioned on the other side of said brace plate, wherein said drive means moves said pressure plate to the rail conveyancer against a tape cassette contained therein and back to said brace plate.

3. A printing machine as recited in claim 2 wherein: said print head subassembly is positioned perpendicular to said rail conveyancer on the side opposite to said back pressure plate subassembly and is comprised of a precision ball slide mounted and aligned on said base, a printing carriage with a multi-die print holder with a printing die attached thereto mounted on said slide and facing said rail conveyancer, and drive means interfaced to said carriage for moving said carriage to the rail conveyancer against a tape cassette contained therein and back.

4. A printing machine as recited in claim 3 wherein: said back pressure plate subassembly and said print head assembly synchronously move at the same time against a tape cassette contained within said rail conveyancer.

5. A printing machine as recited in claim 4 wherein: said form roller moves across the face of said print head subassembly after said print head moves back from said rail conveyancer.

6. A printing machine as recited in claim 5 further comprising:

a resilient pad attached to said pressure plate on the side facing said rail conveyancer.

7. A printing machine as recited in claim 6 wherein: said back pressure plate subassembly guide rods are attached to said pressure plate on the side opposite to said rail conveyancer and pass through openings in said brace plate.

8. A printing machine as recited in claim 7 further comprising:

a resilient pad positioned between said print holder and said die.

9. A printing machine as recited in claim 8 wherein: said rail conveyancer assembly is comprised of two parallel, slotted rails, one rail vertically positioned over the other rail, both held in position by vertical end brackets attached to said base plate, wherein said rail slots are open to said attached supply chute thereby allowing a cartridge to slide into the rail slots.

10. A printing machine as recited in claim 9 wherein: said feeder mechanism is comprised of a vertical plate positioned between said rails within said slots and drive means for moving said vertical plate back and forth within said slotted rails past the point where said supply chute interfaces with said rails.

11. A printing machine as recited in claim 10 further comprising:

a vacuum chamber cleaning system mounted on said rail conveyancer between said supply chute and said printing assembly.

12. A printing machine as recited in claim 11 further comprising:

a dryer station positioned at the end of the rail conveyancer nearest to said printing assembly.

13. A cassette tape cartridge direct ink printing machine comprising:

a base plate;

a cassette tape cartridge feeding assembly mounted on said base plate comprised of a cassette supply chute, a rail conveyancer assembly perpendicularly joined to said supply chute, and a feeder mechanism for moving cassettes from said supply chute into and along said rail conveyancer;

a printing assembly mounted on said base plate comprised of a two print head subassemblies juxtaposed on opposite sides of said rail conveyancer in position to operate on cassettes within said rail conveyancer; and two print inking systems mounted on said base plate each positioned above a print head subassembly and each comprised of two parallel plate brackets each one positioned on one side of a print head subassembly, a cylindrical drive roller attached to said brackets and having a central longitudinal axis positioned in parallel with said rail conveyancer, means to radially drive said roller, a ductor roller attached to said brackets and positioned against and in parallel to said driver roller between said roller and said rail conveyancer, a form roller positioned below and in parallel to said ductor roller and mounted between two vertical rod cylinders positioned between said plate brackets and said rail conveyancer whereby said form roller moves in a vertical motion on said rod cylinders and engages said ductor roller at the apogee of its upward motion and rolls across the face of said print head subassembly during its downward motion, an oscillating roller mounted on a bracket mounted on the top side of parallel brackets housing said rod cylinders wherein said oscillating roller is positioned parallel to and against said ductor roller, and means for moving said oscillating roller side-to-side across the face of said ductor roller.

14. A printing machine as recited in claim 13 wherein: each said print head subassembly is positioned perpendicular to said rail conveyancer on a side opposite to said other print head subassembly and is comprised of a precision ball slide mounted and aligned on said base, a printing carriage with a multi-die print holder with a printing die attached thereto mounted on said slide and facing said rail conveyancer, and drive means interfaced to said carriage for moving said carriage to the rail conveyancer against a tape cassette contained therein and back.

15. A printing machine as recited in claim 14 wherein: each said print head assembly synchronously moves at the same time against a tape cassette contained within said rail conveyancer.

16. A printing machine as recited in claim 15 wherein: said form roller moves across the face of said print head subassembly after said print head moves back from said rail conveyancer.

17. A printing machine as recited in claim 16 further comprising:

a resilient pad positioned between each said print holder and each said die.

18. A printing machine as recited in claim 17 wherein: said rail conveyancer assembly is comprised of two parallel, slotted rails, one rail vertically positioned over the other rail, both held in position by vertical end brackets attached to said base plate, wherein said rail slots are open to said attached supply chute thereby allowing a cartridge to slide into the rail slots.

19. A printing machine as recited in claim 18 wherein:

said feeder mechanism is comprised of a vertical plate positioned between said rails within said slots and drive means for moving said vertical plate back and forth within said slotted rails past the point where said supply chute interfaces with said rails.

20. A printing machine as recited in claim 19 further comprising:

a vacuum chamber cleaning system mounted on said rail conveyancer between said supply chute and said printing assembly.

21. A printing machine as recited in claim 20 further comprising:

a dryer station positioned at the end of the rail conveyancer nearest to said printing assembly.

* * * * *